US005172436A

United States Patent [19]

Masuda

[11] Patent Number: 5,172,436

[45] Date of Patent: Dec. 22, 1992

[54] MATTRESS CUSHION

[75] Inventor: Isamu Masuda, Fukuoka, Japan

[73] Assignee: Nihonkenkozoshinkenkyukai Co., Ltd., Fukuoka, Japan

[21] Appl. No.: 768,308

[22] PCT Filed: Mar. 26, 1990

[86] PCT No.: PCT/JP90/00400

§ 371 Date: Oct. 2, 1991

§ 102(e) Date: Oct. 2, 1991

[87] PCT Pub. No.: WO91/14387

PCT Pub. Date: Oct. 3, 1991

[51] Int. Cl.[5] ..... A47C 27/15

[52] U.S. Cl. ..... 5/448; 5/462; 5/481; 5/901

[58] Field of Search ..... 5/643, 901, 448, 462, 5/468, 481

[56] References Cited

U.S. PATENT DOCUMENTS

| | | | |
|---|---|---|---|
| 2,838,771 | 6/1958 | Goodman et al. | 5/448 |
| 3,319,274 | 5/1967 | Upton | 5/481 |
| 4,122,568 | 10/1978 | Bastos et al. | 5/448 |
| 4,143,435 | 3/1979 | Masuda | 5/481 |
| 4,498,477 | 2/1985 | Masuda et al. | 5/468 X |
| 4,509,219 | 4/1985 | Yagi | 5/481 |
| 4,580,301 | 4/1986 | Ludman et al. | 5/468 X |
| 4,924,542 | 5/1990 | Yamaguchi | 5/481 |
| 4,999,868 | 3/1991 | Kraft | 5/481 X |

*Primary Examiner*—Michael F. Trettel
*Attorney, Agent, or Firm*—Jordan and Hamburg

[57] ABSTRACT

The present invention relates to a mattress cushion, wherein it consists of a cushion mattress not using metal components like coil springs, the mattress body (1) is composed of overlapping elastic surface layers (6) (7) on both sides of a core portion (3) consisting of synthetic resin moldings sandwiched therebetween. Accordingly, the mattress cushion is light and there is no problem of rusting. Also, the core portion (3) is composed of alternately upper and lower horizontal walls (22), (23) connected by adjoining vertical side walls (21) (21), and protrusions (27) are formed on each vertical side wall (21). Accordingly, the mattress cushion increases in strength and improves the ventilation and comfort of the user.

6 Claims, 5 Drawing Sheets

MATTRESS CUSHION

TECHNICAL FIELD

The present invention relates to a mattress cushion, which is used for a mattress or a bed.

TECHNICAL BACKGROUND

A conventional mattress cushion as a bed is constructed such that a number of coil springs are fixed to a metal frame under the both surfaces, overlaid by sheet materials respectively on upper and lower sides and covered by cloth entirely.

In such a kind of mattress, however, since a metal frame and a number of coil springs are incorporated, the gross weight becomes greater and handling is inconvenient. Also, the coil springs and metal frame are not only prominent causes of rust but also for breakage of the sheet material and the cover cloth, negatively affecting the durability of the mattress and the user's comfort.

Moreover, in this kind of bed mattress, as importance is laid only on how to support the body stably, the function of improving health is hardly considered, It is the object of the invention to provide a lightweight mattress and improve the durability of the mattress, by forming a mattress cushion, particularly for a bed, without using a metal component such as a coil spring.

It is another object of the invention to improve the durability of the mattress cushion, the user's comfort and the health of the user by employing a core portion with a special structure.

DISCLOSURE OF THE INVENTION

The invention relates to a mattress cushion having an elastic mattress body covered throughout its periphery by a cover, and formed with the core portion consisting of synthetic resin moldings having rigidity and an elastic surface layer, overlaid on both sides of the core portion sandwiched between them. The said core portion is formed with vertical side-walls at regular intervals and horizontal upper-end walls and lower-end walls connected mutually between the upper-end and the lower-end of the vertical side-walls side by side. Also, the convex part extending up and down are formed at regular intervals on the said vertical side-walls.

In reference to the invention, since a metal member such as a coil spring is not used, the whole mattress is light and easy to handle, and also rusting and breakage of the cover cloth does not occur, thus the durability of the mattress and user's feeling are not comprised.

Furthermore, since the whole mattress is comprised of the core portion of synthetic resin moldings which are rigid and the core portion is formed with a special structure, it is not subject to breakage or deformation by an external force, improving the durability. Also, since the core portion has the function of preventing the body from sinking down, the body may be supported in its natural form, and thus a quiet sleep is insured.

Also, the core portion has a hollow structure, which is good for ventilation and damp-proofing to improve the user's feeling and health with the function of keeping the natural form of the body.

BRIEF DESCRIPTION OF THE INVENTION

Figure 1:
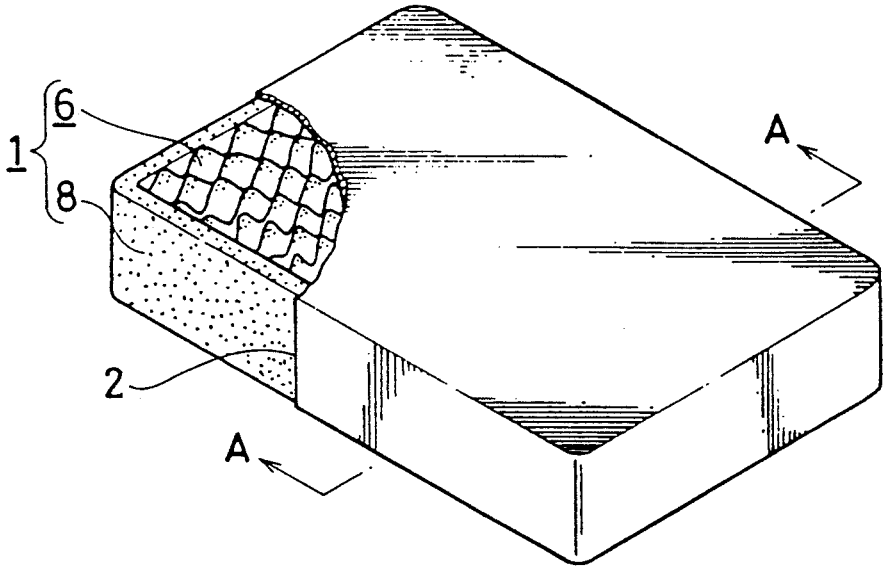
Figure 2:
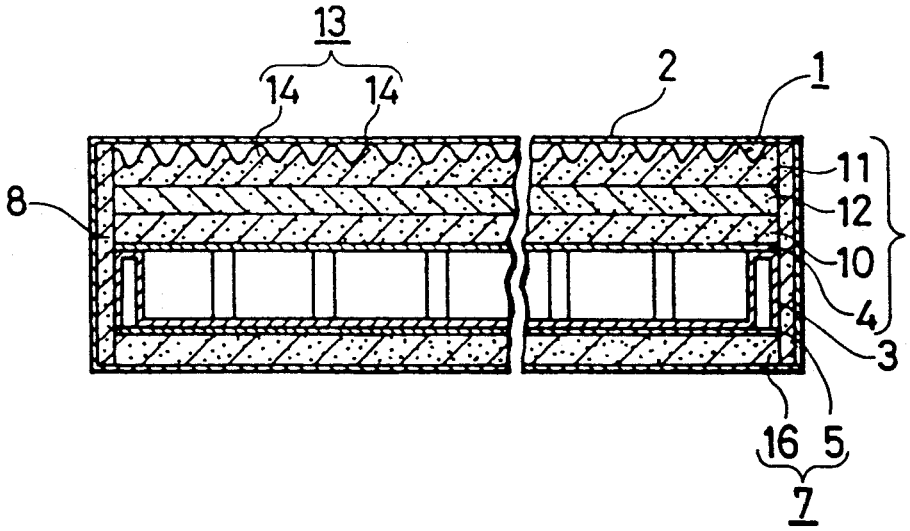
Figure 3:
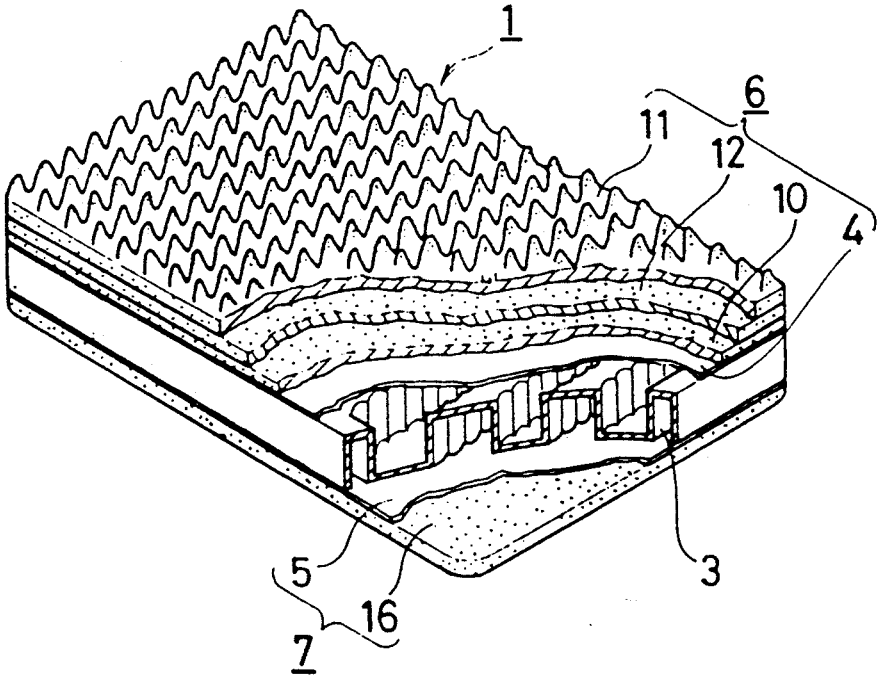
Figure 5:
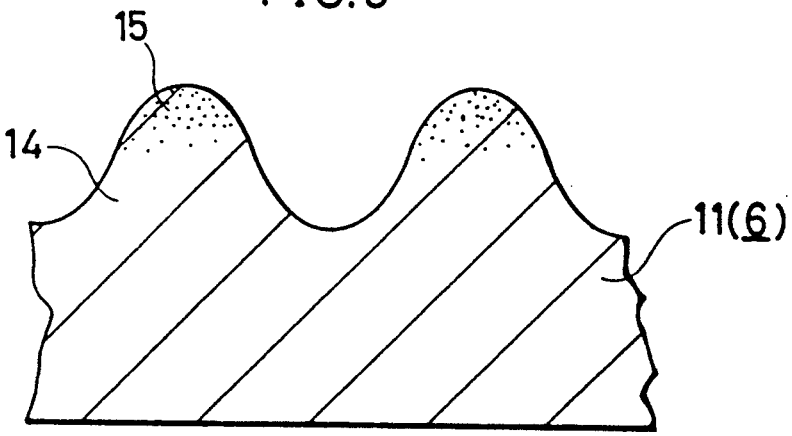
Figure 4:
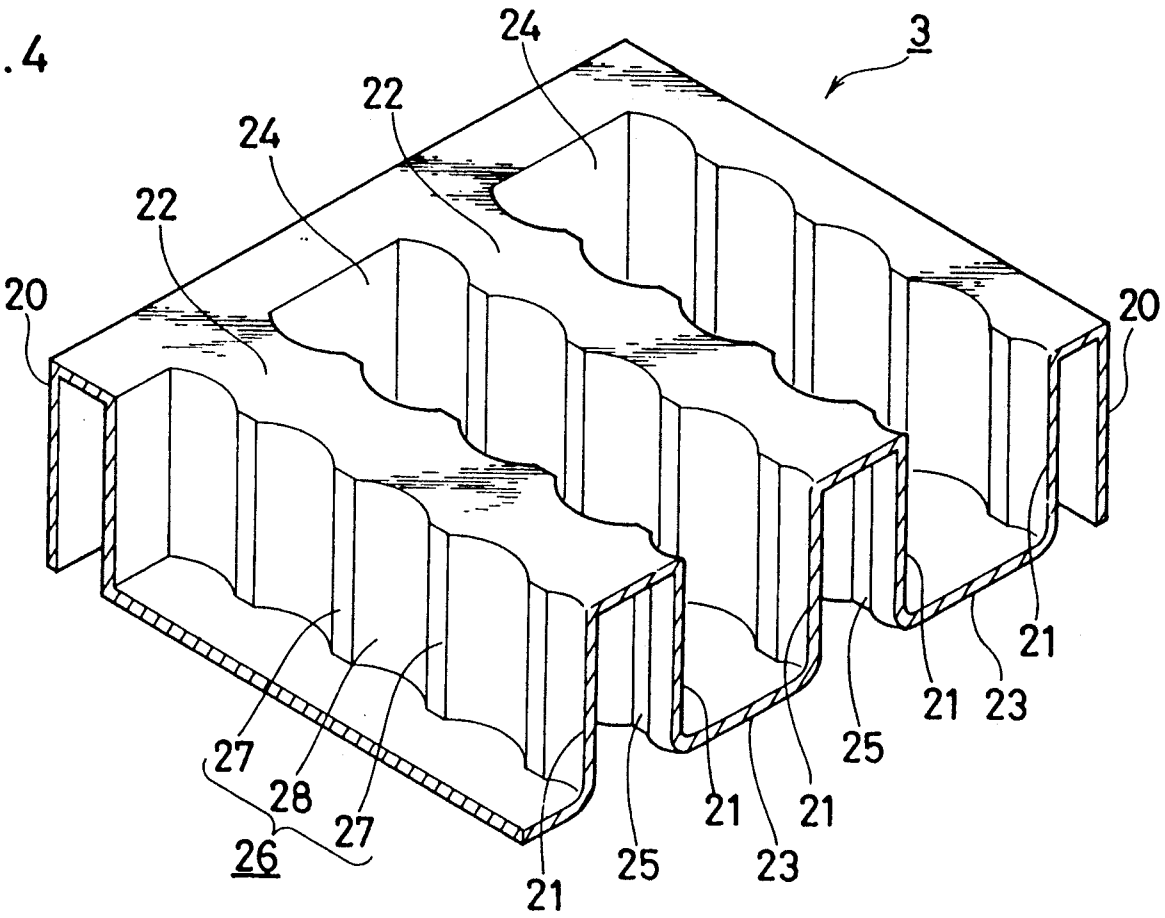
Figure 6:
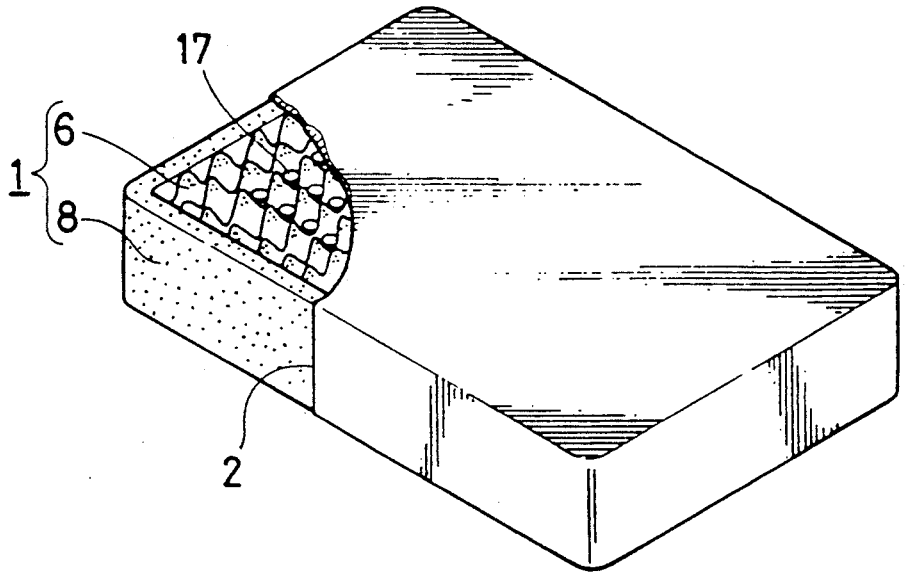
Figure 7:
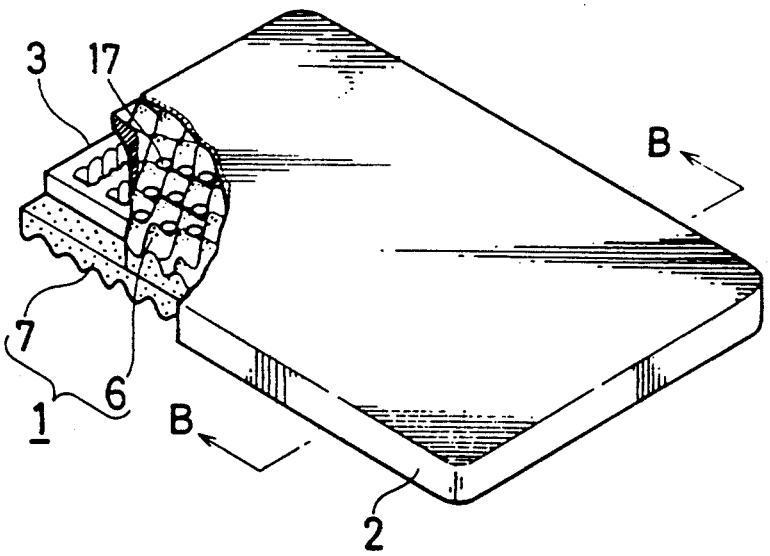
Figure 8:
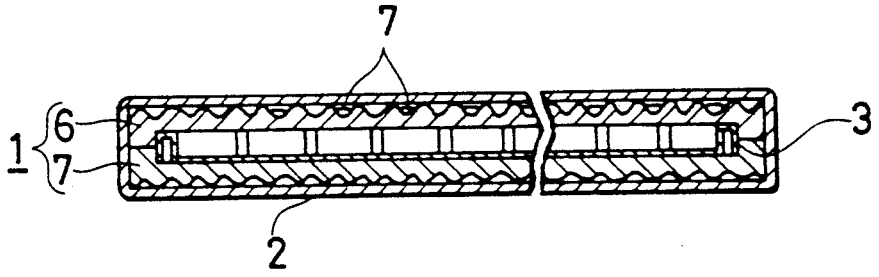

FIG. 1 is a perspective view showing a mattress cushion for a bed with a partly broken cover according to one embodiment of the present invention, FIG. 2 is a sectional view taken along the line A—A of FIG. 1, FIG. 3 is a perspective view showing a lamination structure of a mattress body, each of the layers being broken, FIG. 4 is a perspective view showing a enlarged core portion, FIG. 5 is a sectional view showing an enlarged second cushion layer, FIG. 6 is a perspective view of a mattress cushion for a bed with a cover partly broken according to another embodiment of the invention, FIG. 7 is as perspective view of a mattress cushion for laying our on the floor, with a cover and a surface layer partly broken according to another embodiment of the invention, FIG. 8 is a sectional view taken along the line B—B of FIG. 7.

BEST MODE FOR CARRYING OUT THE INVENTION

FIGS. 1 and 2 show a mattress cushion for a bed according to one embodiment of the invention constructed such that the entire periphery of an elastic mattress body 1 is covered by a cloth cover 2.

The mattress body 1, as shown in FIGS. 2 and 3, is composed of overlapping elastic surface layers 6, 7 on both sides of a core 3 sandwiched between them, and surrounding these laminations is circumferential wall 8. The core portion 3 and respective surface layers 6, 7, and the circumferential wall 8 are bonded into a unit by means of adhesives.

The core portion 3 is formed of synthetic resin having rigidity, and accounts for 50% of the thickness of mattress body 1. The core portion 3 not only serves to lighten the mattress but also serves as the rigid core, thus preventing deformation of the entire mattress.

The core portion 3, as shown in FIG. 4, is constructed such that many vertical side walls 21 are provided at equal intervals inside the circumferential wall 20 surrounding the sides. Upper ends and lower ends of the adjoining vertical side walls 21 are connected alternately by a horizontal upper wall 22 and a horizontal lower wall 23. The circumferential wall 20, each vertical side wall 21, each horizontal upper wall 22 and each horizontal lower wall 23 are formed into an unit, wherein a hollow groove 24 open in the upper portion is formed between the horizontal lower wall 23 and the vertical side walls 21, 21 thereabove, and a hollow groove 25 open in the lower portion is formed between the horizontal upper wall 22 and the vertical side walls 21, 21 thereunder. By the presence of the hollow grooves 24, 25, the ventilation and dehumidifying effects are improved and the core portion 3 becomes lighter.

Each of the vertical side walls 21 is formed into a corrugated surface 26, whereby the strength of the vertical side wall 21 is considerably increased. The corrugated surface 26 includes protrusions 27 which extend vertically in parallel to each other at constant intervals, forming interposing depressions 28 therebetween.

The surface layers 6, 7 respectively include tough protecting plates 4, 5 employed in the upper and lower positions to sandwich the core portion 3.

As the protecting plate 4, a tough synthetic resin plate such as polyethylene which is not readily deformable can be used to protect the core portion 3 from immoderate forces exerted by a body, and to prevent the body from sinking against elastic surface layer 6. As for protecting plate 4, compressed plywood may be used in place of the synthetic resin plate, if it is strong enough.

The protecting plate 5 on the bottom side is for protecting the core portion 3 in the same way as the protecting plate 4 on the upper surface side, and a synthetic resin plate is preferably used. However when the upper and lower portion of the mattress is fixed in this way, though the strength may be small, a paper board (e.g. corrugated fiberboard) which is light and has hygroscopic properties can be used.

The upper surface layer 6 on the surface side, in the case of this embodiment, has a three-layer structure of different types of cushion materials, comprising a first cushion layer 10 on the bottom, a second cushion layer 11 on the top and a third cushion layer 12 in the center.

The first cushion layer 10 is formed by a soft air permeable cushion material such as a soft urethane foam, and gives strong elasticity to the body by sufficiently deforming elastically against the load.

The second cushion layer 11 is formed by a semihard air permeable cushion material such as a semihard urethane foam, and supports the body by deforming slightly against the load. The cushion material is formed into a semihard body by impregnating the semihard polyurethane foam entirely with rubber latex and drying by heating to harden the rubber latex. The entire surface of the cushion material is formed with a depression-and-protrusion surface 13, whose respective protrusions 14 include a hardened portion 15 as shown in FIG. 5. The hardened portion 15 is formed by impregnating the rubber latex only on the apex of the protrusion 14 and is hardened by the same heating and drying process. By the presence of the hardened portion 15, the protrusions 14 are not crushed by the pressure and the body is supported by point contact, so that air permeability is improved by gaps produced between the body and the cushion material and also a finger-pressure force may be applied to the body.

The third cushion layer 12 is formed by a cushion material constructed by pressing and hardening urethane chips while heating, whereby the body is supported with a mild elasticity and the surface layer 6 is strengthened.

The bottom side surface layer 7 is formed by the same material as the first cushion layer 10, namely, by a soft air permeable cushion material 16 such as a soft urethane foam. The soft cushion material 16 provides a strong elasticity to the body by sufficiently deforming elastically against the load. The circumferential wall 8 is also formed by the same soft cushion material, protecting the laminate structure of the mattress body from the circumference.

FIG. 6 shows another embodiment of the invention, in which a number of permanent magnets 17 are disposed on the surface side of surface layer 6 of the mattress body 1. The permanent magnets 17 are fixed to the depressions of the depression-and-protrusion surface 13 on the second cushion layer 11 by adhesives for the purpose of applying lines of magnetic force to the body to obtain a predetermined magnetic treatment effect.

FIGS. 7 and 8 show another embodiment of the invention, which is a cushion mattress for laying out on the floor. This type of cushion mattress is constituted by overlapping surface layers 6, 7 comprising semihard cushion material which sandwiches the core portion 3 having same structure as the above said core portion. Also, the circumference of the face layers 6,7 are adhered to each other, which is covered by a cloth cover 2. Also, a number of permanent magnets 17 are disposed and fixed with adhesive on the surface layer 6 on the surface side.

INDUSTRIAL APPLICABILITY

A mattress cushion for a bed as shown in FIG. 1 is used so that it is arranged on a bed and covered with a thin bed sheet. When a person lies on the mattress, a suitable elasticity is given mainly by a first cushion layer 10, on the surface side surface layer 6 and soft cushion material 16 on the bottom side surface layer 7, and the body is supported by a second cushion layer 11. In this case, a protecting plate 4 and the core portion 3 on the upper surface side supports the body in a natural form against the elastic deformation of the surface layer 6 such that it will sink down in an unnatural form, insuring a quiet sleep.

Also, when the downward load is applied on the core portion 3, though it operates on the horizontal upper wall 22, vertical side wall 21 and horizontal lower wall 23, the protrusions 27 on the vertical side wall 21 serve as ribs, the strength is increased to support it sufficiently against the concentrated loads. Also, even when the load is applied downward obliquely, the adjoining vertical side walls 21, 21 cooperate to prevent deformation and the protrusions 27 prevent the vertical side wall 21, from bending under loads.

On the second cushion layer 11, since there is provided a hardened portion 15 on each of the protrusions 14 of the depression-and-protrusion surface 13, the protrusions 14 are not crushed by the loads and the body is supported in point contact by the hardened portion 15 of the respective protrusions 14. Accordingly, gaps produced between the body and the second cushion layer 11 improve not only the ventilation and the dehumidifying effect but also the comfort of the user. In addition, the protrusions 14 of the depression-and-protrusion surface 13 press the right places of the body to provide a finger-pressure, resulting in improving the circulation of the blood and health.

Moreover, in the embodiment shown in FIG. 6, lines of magnetic force emitted from permanent magnet 16 operate on the body to further improve the circulation of the blood, thereby eliminating stiff shoulders and reducing fatigue.

When transporting such a mattress, since metal members are not used in the mattress body 1 and hollow synthetic resin moldings are used as the core portion 3, the whole mattress may be made lighter and it can be handled easily. Also, there is no problem of rust or breakage, thus good durability and user's comfort can be realized.

A cushion sheet as shown in FIG. 7 which is used as a mattress for laying out on the floor and regarding the function of the core portion 3, is the same as the embodiment shown in FIG. 1 and the explanation of it is omitted here.

What is claimed is:

1. A mattress cushion comprising:

a) an elastic mattress body including:

(1) a core portion formed of a synthetic resin molding having a rigidity, said core portion having upper and lowr opposite sides, said core portion including:

(A) vertical side walls spaced from each other at regular intervals, said vertical side walls including vertical convex parts spaced from each other at regular intervals along said vertical side walls;

(B) horizontal upper walls alternately connecting upper ends of said vertical side walls; and (C) horizontal lower walls alternately connecting lower ends of said vertical side walls at positions between said horizontal upper walls;

(2) an elastic surface layer overlaying said upper side of said core portion; and (3) an elastic surface layer overlaying said lower side of said core portion; and b) cover means for entirely covering said elastic mattress body.

2. A mattress cushion according to claim 1, wherein each of said upper and lower elastic surface layers includes a tough protecting plate, with said protecting plates sandwiching said core portion therebetween.

3. A mattress cushion according to claim 1, wherein the upper elastic surface layer includes a plurality of cushion layers, each comprised of a different type of cushion material.

4. A mattress cushion according to claim 1, wherein the upper elastic surface layer includes a plurality of permanent magnets.

5. A mattress cushion according to claim 1, wherein the upper elastic surface layer includes an upper surface having a plurality of upwardly extending protrusions therein, with depressions being defined between said protrusions.

6. A mattress cushion according to claim 5, wherein the upper elastic surface layer further includes a plurality of permanent magnets positioned on the upper surface thereof in said depressions.

* * * * *